US010663193B2

(12) United States Patent
Jain

(10) Patent No.: US 10,663,193 B2
(45) Date of Patent: May 26, 2020

(54) INSTANT WATER HEATER

(71) Applicant: Sanjeev Jain, Vancouver, WA (US)

(72) Inventor: Sanjeev Jain, Vancouver, WA (US)

( * ) Notice: Subject to any disclaimer, the term of this patent is extended or adjusted under 35 U.S.C. 154(b) by 0 days.

(21) Appl. No.: 16/378,710

(22) Filed: Apr. 9, 2019

(65) Prior Publication Data

US 2019/0368777 A1 Dec. 5, 2019

Related U.S. Application Data

(60) Provisional application No. 62/680,041, filed on Jun. 4, 2018.

(51) Int. Cl.

| | |
|---|---|
| ***F24H 1/14*** | (2006.01) |
| ***F24H 1/18*** | (2006.01) |
| ***F24H 9/20*** | (2006.01) |
| *F24H 1/10* | (2006.01) |
| *F24H 9/12* | (2006.01) |

(52) U.S. Cl.

CPC ..... *F24H 1/185* (2013.01); *F24H 9/2021* (2013.01); *F24H 1/101* (2013.01); *F24H 1/102* (2013.01); *F24H 9/128* (2013.01); *F24H 2250/14* (2013.01)

(58) Field of Classification Search

None

See application file for complete search history.

(56) References Cited

U.S. PATENT DOCUMENTS

| | | | | |
|---|---|---|---|---|
| 3,167,066 | A * | 1/1965 | Hughes | F23C 99/006 122/18.31 |
| 4,600,375 | A * | 7/1986 | Honsho | B29C 45/462 425/174.4 |
| 5,371,830 | A * | 12/1994 | Wachenheim | F24H 1/102 392/487 |
| 5,559,924 | A | 9/1996 | Kadotani et al. | |
| 5,790,752 | A * | 8/1998 | Anglin | F24H 1/102 392/419 |
| 6,246,831 | B1 * | 6/2001 | Seitz | F24H 9/2021 219/483 |
| 6,696,671 | B2 * | 2/2004 | Boehnke | B29B 13/022 219/388 |
| 7,421,194 | B2 | 9/2008 | Lin | |
| 7,903,958 | B2 | 3/2011 | Tsai | |

(Continued)

*Primary Examiner* — Joseph M Pelham

(74) *Attorney, Agent, or Firm* — Boudwin Intellectual Property; Daniel Boudwin

(57) ABSTRACT

An instant water heater. The instant water heater includes a housing having a transparent reservoir configured to store liquid water. The reservoir includes an inlet and an outlet in fluid communication with a building's existing water supply lines. A plurality of infrared lights are disposed around a perimeter of the reservoir. A plurality of reflectors disposed around each infrared light are configured to direct the emitted light energy to the reservoir, in order to heat the water therein. A control circuit is operably connected to the infrared lights, and is configured to receive input commands and selectively activate the plurality of infrared lights in order to heat water within the reservoir. Other parameters such as a flow rate and water pressure can be monitored and controlled wirelessly or on an included display screen. The device can be utilized to quickly and efficiently heat water to a desired temperature.

21 Claims, 5 Drawing Sheets

(56) References Cited

U.S. PATENT DOCUMENTS

| | | | | |
|---|---|---|---|---|
| 8,670,656 | B2 * | 3/2014 | Nishida | F24H 1/162 392/424 |
| 9,702,585 | B2 * | 7/2017 | Hayden | F24H 1/0018 |
| 2010/0133258 | A1 * | 6/2010 | Fima | F17D 5/02 219/482 |
| 2010/0212752 | A1 * | 8/2010 | Fima | F24H 9/2007 137/87.03 |
| 2012/0080422 | A1 | 4/2012 | Chung et al. | |
| 2012/0275775 | A1 | 11/2012 | Iskrenovic | |
| 2014/0023354 | A1 * | 1/2014 | Hankins | F24H 1/102 392/480 |
| 2019/0072327 | A1 * | 3/2019 | Kisner | F26B 5/02 |

* cited by examiner

INSTANT WATER HEATER

CROSS REFERENCE TO RELATED APPLICATIONS

This application claims the benefit of U.S. Provisional Application No. 62/680,041 filed on Jun. 4, 2018. The above identified patent application is herein incorporated by reference in its entirety to provide continuity of disclosure.

BACKGROUND OF THE INVENTION

The present invention relates to water heaters. More particularly, the present invention provides an instant water heater having an internal water reservoir, a plurality of infrared lights, a plurality of reflectors for directing light toward the reservoir to heat the water therein, and a control circuit to monitor and control various parameters of the instant water heater.

Most buildings include running water that is transported to various outlets like sink faucets and shower heads via water supply lines. At such outlets, there are often one or more control knobs for controlling the temperature of the dispensed water. Individuals often prefer warm water for showering, bathing, washing dishes, and performing other tasks. In order to dispense warm water, the user rotates the knob or otherwise activates the water controls to a position that corresponds to a desired water temperature.

Water is typically warmed by a water heater that is operably connected to the overall water distribution system for the building. Typical water heaters utilize oil or natural gas to heat water stored within a large reservoir. However, these types of water heaters have several drawbacks. With these water heaters, water must be run continuously until a desired temperature is reached. Since these types of water heaters utilize large tanks to hold water, users must often wait inordinate lengths of time before a desired water temperature is reached. In instances where a small amount of warm water is needed, it can be incredibly inefficient to heat the entire reservoir and divert the heated water to the selected outlet. Further, large volumes of water can be wasted while the individual waits for the water to reach the desired temperature, which is detrimental to the environment, particularly in areas affected by drought or other fresh water shortages.

An additional drawback to typical water heaters is that hot water is normally dispensed via water outlets that have manually operable controls, such as faucets, knobs, and the like. Oftentimes, a user turns a hot water knob and leaves it to run without feeling for the temperature first, which may result in the user scalding themselves with water that is too hot for personal use. In order to address these concerns, it is desirable to provide an instant water heater device that utilizes infrared light to quickly heat water stored within a reservoir that is connected to the water distribution system of a building, such that the instant water heater can supplement or modify a typical water heater. Further, it is desirable to provide an instant water heater that includes a control circuit and input controls so that users may remotely control the temperature, flow rate, pressure, and other parameters of the instant water heater.

Devices have been disclosed in the known art that relate to water heaters that utilize infrared light to heat water. These include devices that have been patented and disclosed in published patent applications. However, the devices in the known art have several drawbacks. Many of the devices in the known art are large, bulky, and intended to completely replace a traditional water heater rather than supplement it. Further, the devices in the known art lack an adequate number of internal reflective surfaces to maximize the transmission of heat energy from the infrared lights to the water stored therein. Additionally, the devices in the known art fail to provide an infrared water heater that includes user controls for remotely adjusting the temperature, water pressure, and flow rate at a desired water outlet.

In light of the devices disclosed in the known art, it is submitted that the present invention substantially diverges in design elements from the devices in the art and consequently it is clear that there is a need in the art for an improvement of infrared water heater devices. In this regard the present invention substantially fulfills these needs.

SUMMARY OF THE INVENTION

In view of the foregoing disadvantages inherent in the known types of water heaters now present in the prior art, the present invention provides an instant water heater wherein the same can be utilized for providing convenience for the user when using infrared light to quickly and efficiently heat water to a desired temperature. In one embodiment of the present invention, the instant water heater includes a housing comprising a base, a plurality of sidewalls extending upwardly therefrom, and a top wall defining an interior volume. A transparent reservoir disposed is within the housing and is configured to store liquid water therein. The reservoir comprises an inlet and an outlet in fluid communication with the water supply lines of a building. A plurality of infrared lights are disposed around a perimeter of the reservoir. A plurality of reflectors are disposed around each infrared light, wherein an interior surface of each reflector comprises a reflective surface configured to direct light from each infrared light to the reservoir. Further, a control circuit is operably connected to the infrared lights, and is configured to receive input commands and selectively activate the plurality of infrared lights in order to heat liquid water within the reservoir.

One object of the present invention is to provide an instant water heater that includes all of the advantages of devices in the known art and none of the disadvantages.

Another object of the present invention is to provide an instant water heater that includes temperature sensors, pressure sensors, and flow rate sensors, such that these parameters can be monitored and controlled by a user.

A further object of the present invention is to provide an instant water heater that utilizes a plurality of internal reflectors to quickly and efficiently heat water via the application of infrared light.

Yet another object of the present invention is to provide an instant water heater that can be integrated into the existing water supply lines of a building.

Still a further object of the present invention is to provide an instant water heater that can be utilized in conjunction with or as supplementation to an existing water heater.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
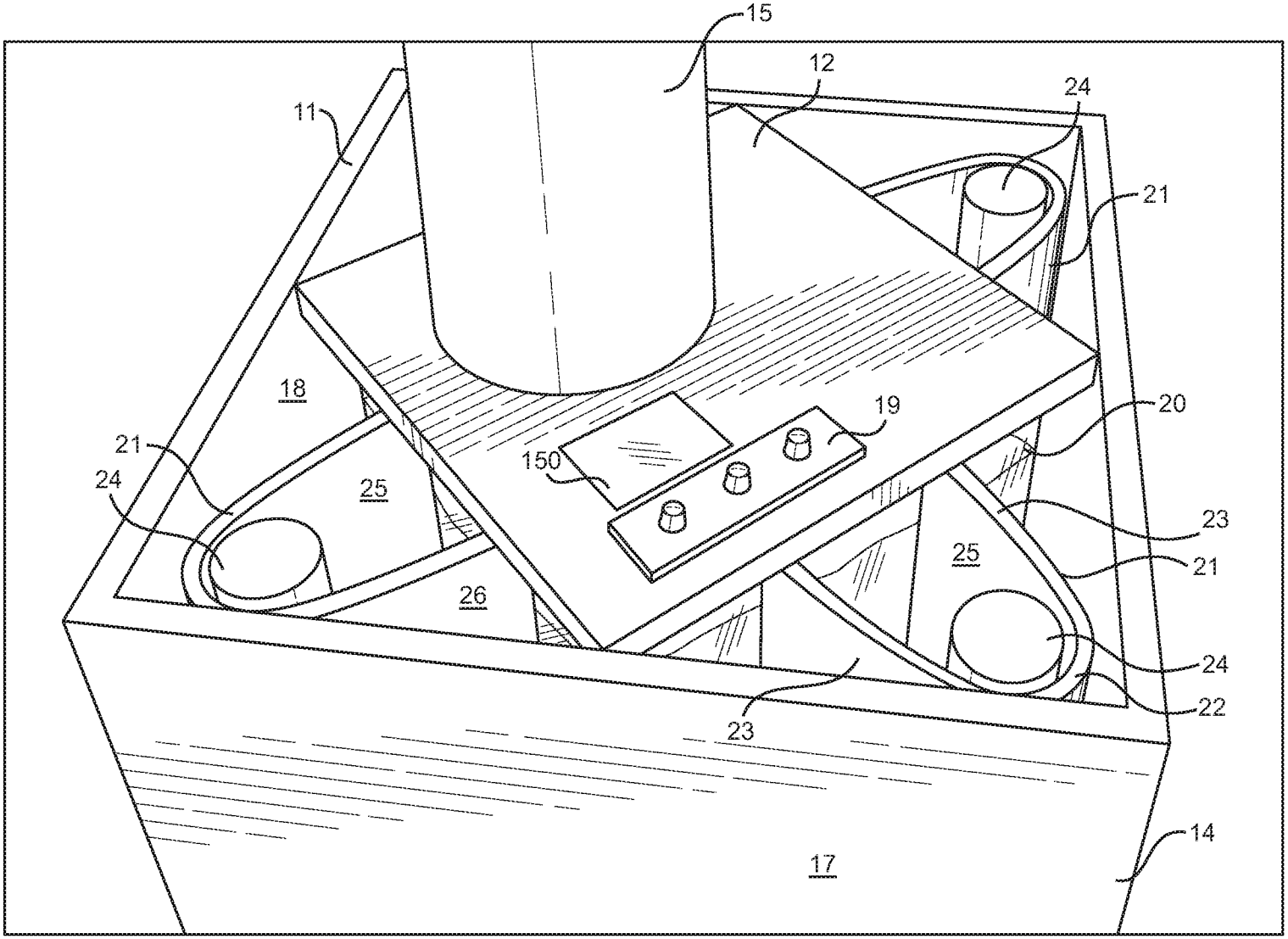
FIG. 1 shows a perspective view of an embodiment of the instant water heater.

Reference is made herein to the attached drawings. Like reference numerals are used throughout the drawings to depict like or similar elements of the instant water heater. For the purposes of presenting a brief and clear description of the present invention, the preferred embodiment will be discussed as used for heating water to a desired temperature via the application of infrared light. The figures are intended for representative purposes only and should not be considered to be limiting in any respect.

Figure 3:
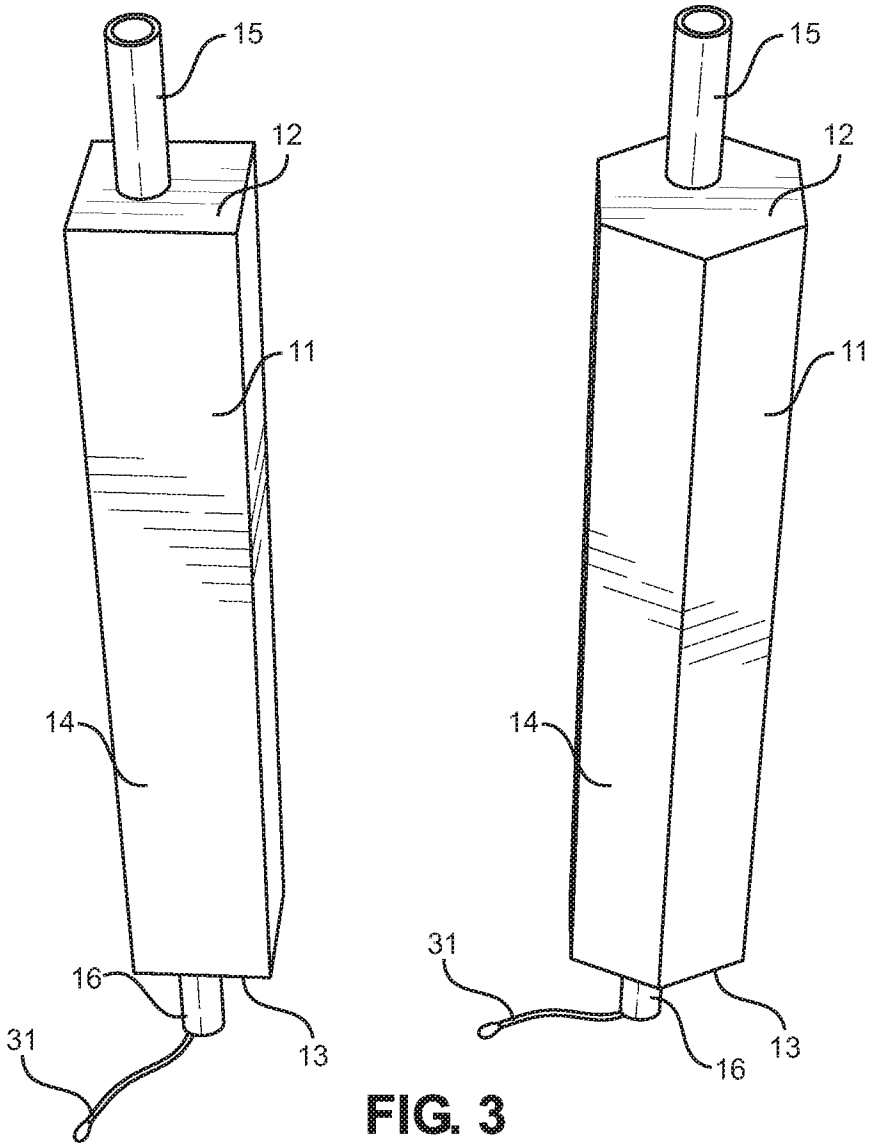
FIG. 3 shows perspective views of the housings of multiple embodiments of the instant water heater.

Referring now to FIG. 1, there is shown a perspective view of an embodiment of the instant water heater. The instant water heater includes a housing 11 having a base (not visible), a plurality of sidewalls 14 extending upwardly therefrom, and a top cover 12 defining an interior volume. In the shown embodiment, the top cover 12 is reduced in size to show the internal components of the instant water heater. However, the top cover 12 may cover the entire upper end of the housing 12, as shown in FIG. 3. Further, in the shown embodiment, the housing 11 includes a square cross-sectional area. However, other embodiments may include different cross-sectional shapes dependent on the number of sidewalls 14 and other internal components. For example, see FIG. 4, which shows a perspective view of an embodiment of the instant water heater where the housing includes a hexagonal cross-sectional area.

A reservoir 20 is disposed within the housing 11. The reservoir 20 includes an inlet 15 extending outwardly from one end of the housing and an outlet (not visible, see FIG. 3) extending outwardly from another end of the housing. The inlet 15 and outlet are in fluid communication with the water supply line of a building. Further, the reservoir 20 is composed of transparent materials, such that light from a plurality of infrared lights 24 surrounding the perimeter of the reservoir 20 is transmitted to the water stored within the reservoir 20. Each infrared light 24 is surrounded by a reflector 21, and each reflector 21 includes a reflective interior surface 25 that is configured to direct emitted light toward the reservoir 20. The reflective interior surface 25 can be a layer of reflective material applied to the reflector 21 via an adhesive or other fastening mechanism, or the reflector 21 may be composed entirely of a reflective material.

In the shown embodiment, each reflector 21 includes a curved base 22 and a pair of wing members 23 extending outwardly from opposing ends thereof, forming a generally parabolic shape. In alternate embodiments, the reflectors 21 can include different shapes. Further, in the shown embodiment, a distal end of each wing member 23 contacts the reservoir 11, and each infrared light 24 is positioned such that it is bounded by the reflective interior surface of a reflector 21 and the transparent surface of the reservoir 20. Such positioning ensures that a maximal amount of light energy is transferred from the infrared lights 24 to the water within the reservoir 20. Further, in some embodiments, the interior surface 18 of the housing 11 is reflective to further enhance the transmission of energy from the infrared lights 24 to the water in the reservoir 20. The housing 11 reflective surfaces may include interior sides of the base, sidewalls 14, top wall 12, or any combination thereof.

In the illustrated embodiment, the housing 11 further includes an electronic display 150 and one or more input controls 19 disposed thereon. The infrared lights 24 can be controlled via the input controls 19. Further, various characteristics of the water stored within the reservoir 20, such as the temperature, flow rate, and pressure, can be controlled and monitored via the input controls 19 and the electronic display 150. In the shown embodiment, the input controls 19 and the electronic display 150 are disposed on the top cover 12 of the housing 11, but each may be located elsewhere on the housing 11 in other embodiments.

Figure 2:
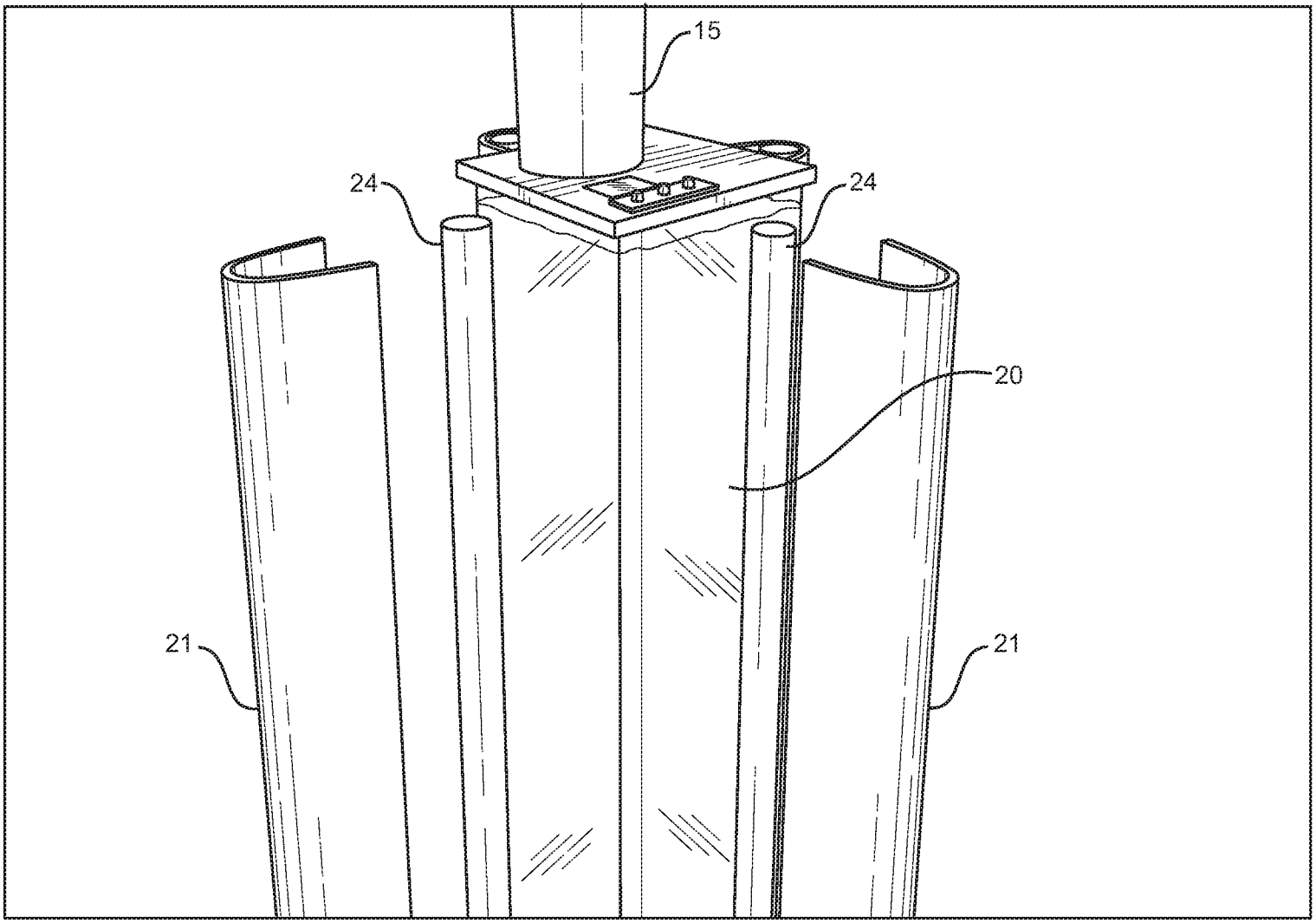
FIG. 2 shows an expanded view of an embodiment of the instant water heater.

Referring now to FIG. 2, there is shown an expanded view of an embodiment of the instant water heater. The infrared lights 24 are illustrated as elongated tubular bulbs that extend from an upper end of the reservoir 20 to a lower end of the reservoir 20, in order to ensure that all of the water stored therein can receive emitted light from the infrared lights 24. While this configuration ensures efficiency, other types and configurations of infrared lights 24 may be utilized. Further, any number or configuration of reflectors 21 may be utilized in order to maximize energy transfer between the infrared lights 25 and the water within the reservoir 20.

Referring now to FIG. 3, there are shown perspective views of the housings of multiple embodiments of the instant water heater. In the illustrated embodiment, the reservoir inlet 15 extends upwardly from the top wall 12 of the housing 11, and the reservoir outlet 16 extends downwardly from the base 13 of the housing 11. The infrared lights 24 and other electronic components of the instant water heater are operably connected to a power source. In the illustrated embodiment, the instant water heater includes a power cord 31 that may be configured to connect to a standard wall outlet. In other embodiments, the instant water heater can include other types of power sources, such as rechargeable battery power or a direct hardwire connection to a building's electrical circuitry. FIG. 3 further illustrates how the housing 11 can include different shapes, such as a rectangular cuboid or hexagonal cuboid shape, for example.

Figure 4:
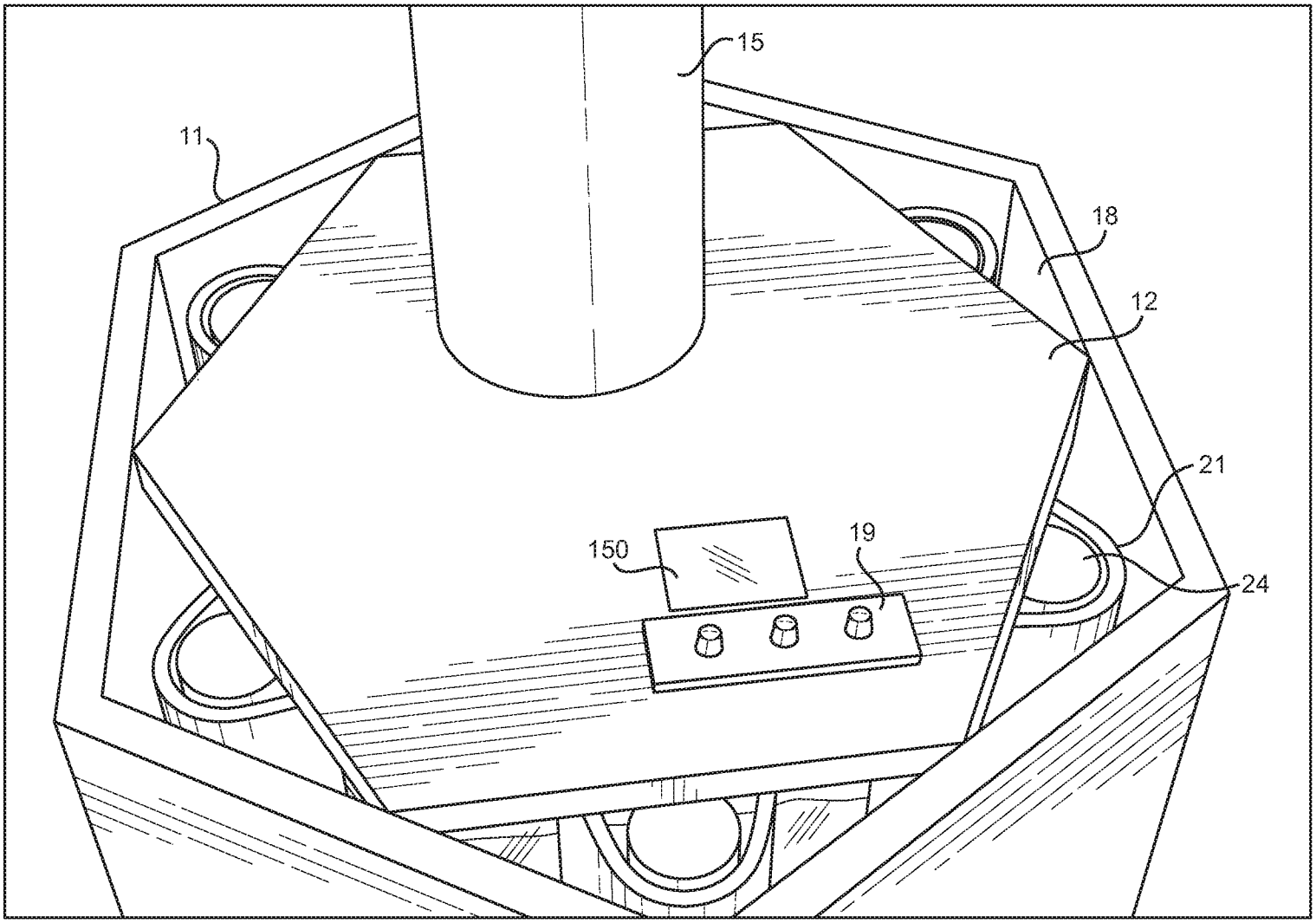
FIG. 4 shows a perspective view of an alternate embodiment of the instant water heater.

Referring now to FIG. 4, there is shown a perspective view of an alternate embodiment of the instant water heater. In the illustrated embodiment, the housing 11 includes a hexagonal cross-sectional area. In practice, the greater number of interior sides 18 of the sidewalls of the housing 11, the greater the transmission of light from the infrared lights 24 to the reservoir will be. The top wall 12 is shown as a hexagonal shape and is reduced in size to show the internal components, but the top wall 12 can fully cover the upper end of the housing 11 in practice. Further, the inlet 15 is shown extending upwardly from the top wall 12, but may be disposed elsewhere in other embodiments.

Figure 5:
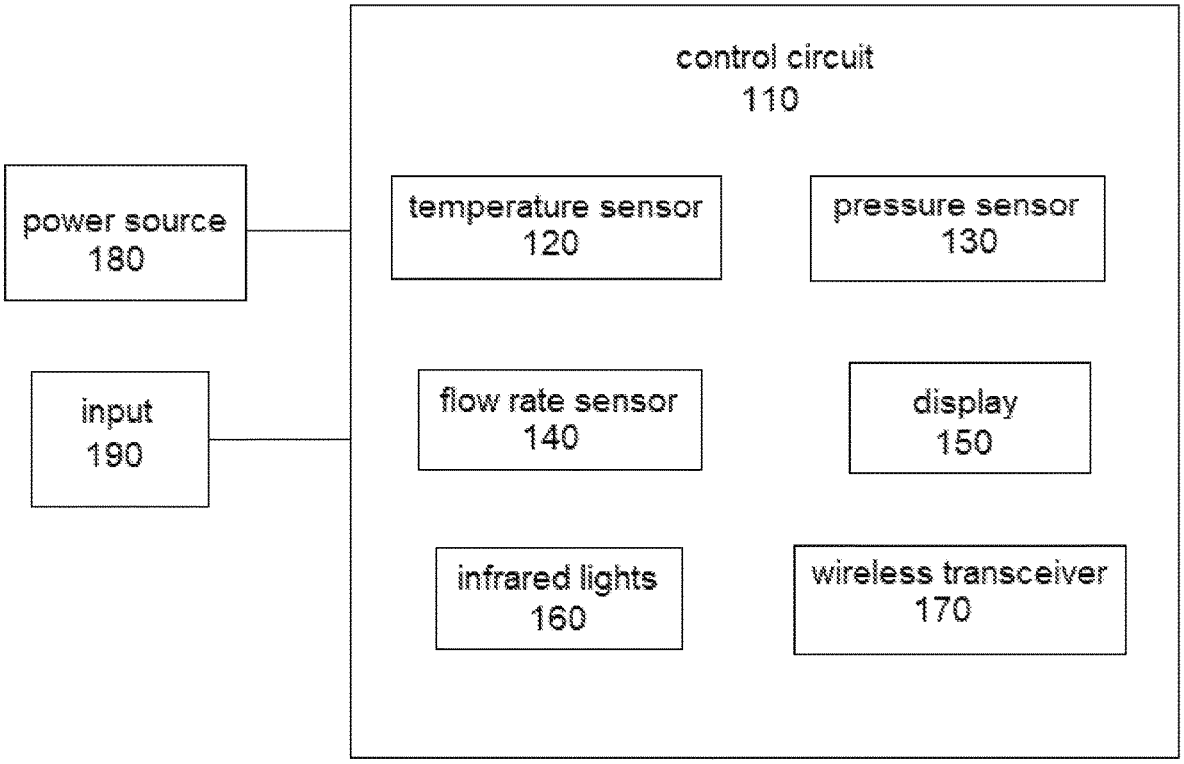
FIG. 5 shows a diagram of the electronic components of an embodiment of the instant water heater.

Referring now to FIG. 5, there is shown a diagram of the electronic components of an embodiment of the instant water heater. The instant water heater includes a power source 180 that is operably connected to a control circuit 110, which is in turn operably connected to the infrared lights 160 in order to selectively activate them to heat water within the reservoir, upon receiving input commands via an input 190. In some embodiments, the input 190 can be received via input controls disposed on the housing. In other embodiments, the control circuit 110 is operably connected to a wireless transceiver 170 that is configured to receive wireless control signals, such that the input 190 can be received remotely. For example, the wireless transceiver 170 may receive control signals from a remote electronic device such as a dedicated remote control, a smartphone, or any other electronic device that is capable of communicating wirelessly via RF, Wi-Fi, Bluetooth, or any other suitable wireless communication protocols.

In the illustrated embodiment, the control circuit 110 is operably connected to a plurality of sensors that are configurated to monitor and control various functions and characteristics of the instant water heater. For example, in the shown embodiment, the control circuit 110 is operably connected to a temperature sensor 120 that is configured to determine the temperature of water within the reservoir, a pressure sensor 130 that is configured to determine the pressure of the water as it exits the reservoir, and a flow rate sensor 140 that is configured to determine the rate of flow of the water as it exists the reservoir. The control circuit 110 is further operably connected to the display 150, such that the current or set temperatures, pressures, and flow rates can be shown on the display 150. Alternatively, the control circuit 110 can communicate the sensor readings to a remote device, such as a smartphone, via the wireless transceiver 170.

In operation, users may provide the input 190 to the control circuit 110 to control the various characteristics of the water as it exits the reservoir and is dispensed through a faucet for use. Users can input their desired temperature, flow rate, and water pressure, such that the control circuit 110 automatically activates the infrared lights 24 and other electronic components, including pumps, valves, or the like, in order to achieve the desired parameters for the water that exists the faucet. In some embodiments, the control circuit 110 can include a memory storage that allows users to store customized water characteristic profiles, such that an individual user can quickly and easily select a their previously inputted water temperature, pressure, and flow rate. In this way, the instant water heater can quickly and efficiently dispense water at a desired water temperature, pressure, or flow rate, allowing users to easily customize the characteristics of the dispensed water.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An instant water heater, comprising;

a housing comprising a base, a plurality of sidewalls extending upwardly therefrom, and a top wall defining an interior volume;

a transparent reservoir defined by a plurality of walls, the reservoir disposed within the housing configured to store liquid water therein, the reservoir comprising an inlet and an outlet;

a plurality of infrared lights disposed around a perimeter of the reservoir;

a plurality of reflectors disposed around each infrared light, wherein an interior surface of each reflector comprises a reflective surface configured to direct light from each infrared light to the reservoir;

wherein each reflector comprises a base portion and a pair of curved wings extending outwardly therefrom, wherein a distal end of each wing contacts an outer surface of the reservoir;

a control circuit operably connected to the infrared lights, wherein the control circuit is configured to receive input commands and selectively activate the plurality of infrared lights in order to heat liquid water within the reservoir.

2. The instant water heater of claim 1, wherein the inlet and the outlet are both in fluid communication with a water supply line of a building.

3. The instant water heater of claim 1, wherein each infrared light is positioned within an interior volume bounded by the interior surface of the reflector and an exterior surface of the reservoir.

4. The instant water heater of claim 1, wherein an interior surface of the sidewalls of the housing comprises a reflective material.

5. The instant water heater of claim 1, further comprising an electronic display disposed on an exterior portion of the housing.

6. The instant water heater of claim 1, further comprising one or more input controls disposed on an exterior portion of the housing.

7. The instant water heater of claim 1, wherein the control circuit is operably connected to a power source.

8. The instant water heater of claim 7, wherein the power source comprises a wired connection to a wall outlet.

9. The instant water heater of claim 1, further comprising a wireless transceiver operably connected to the control circuit, wherein the wireless transceiver is configured to receive command signals from a remote device in order to remotely operate the instant water heater.

10. The instant water heater of claim 1, wherein one infrared light of the plurality of infrared lights is disposed on each wall of the reservoir, such that the number of walls is equal to the number of infrared lights.

11. The instant water heater of claim 1, wherein the reservoir comprises a same cross-section of the housing, the reservoir radially offset within the housing.

12. An instant water heater, comprising:

a housing comprising a base, a plurality of sidewalls extending upwardly therefrom, and a top wall defining an interior volume;

a transparent reservoir disposed within the housing and configured to store liquid water therein, the reservoir comprising an inlet and an outlet;

a plurality of infrared lights disposed around a perimeter of the reservoir;

a plurality of reflectors disposed around each infrared light, wherein an interior surface of each reflector comprises a reflective surface configured to direct light from each infrared light to the reservoir;

wherein each reflector comprises a base portion and a pair of curved wings extending outwardly therefrom, wherein a distal end of each wing contacts an outer surface of the reservoir;

a temperature sensor configured to measure the temperature of water within the reservoir;

a flow sensor configured to measure the flow rate at the inlet and outlet of the reservoir;

a pressure sensor configured to measure the water pressure of water within the reservoir;

a control circuit operably connected to the infrared lights, wherein the control circuit is configured to receive input commands and selectively activate the plurality of infrared lights in order to heat liquid water within the reservoir.

13. The instant water heater of claim 12, further comprising a wireless transceiver operably connected to the control circuit, wherein the wireless transceiver is configured to receive command signals from a remote device in order to remotely operate the instant water heater, and wherein the wireless transceiver is further configured to transmit one or more characterizations of the water within the reservoir to a remote device, wherein the one or more characterizations are determined by one or more of the temperature sensor, flow sensor, and pressure sensor.

14. The instant water heater of claim 12, wherein the inlet and the outlet are both in fluid communication with a water supply line of a building.

15. The instant water heater of claim 12, wherein each infrared light is positioned within an interior volume bounded by the interior surface of the reflector and an exterior surface of the reservoir.

16. The instant water heater of claim 12, wherein an interior surface of the sidewalls of the housing comprises a reflective material.

17. The instant water heater of claim 12, further comprising an electronic display disposed on an exterior portion of the housing.

18. The instant water heater of claim 12, further comprising one or more input controls disposed on an exterior portion of the housing.

19. The instant water heater of claim 12, wherein the control circuit is operably connected to a power source.

20. The instant water heater of claim 19, wherein the power source comprises a wired connection to a wall outlet.

21. An instant water heater, comprising;

a housing comprising a base, a plurality of sidewalls extending upwardly therefrom, and a top wall defining an interior volume;

a transparent reservoir defined by a plurality of walls, the reservoir disposed within the housing configured to store liquid water therein, the reservoir comprising an inlet and an outlet;

a plurality of infrared lights disposed around a perimeter of the reservoir;

wherein one infrared light of the plurality of infrared lights is disposed on each wall of the reservoir, such that the number of walls is equal to the number of infrared lights;

a plurality of reflectors disposed around each infrared light, wherein an interior surface of each reflector comprises a reflective surface configured to direct light from each infrared light to the reservoir;

a control circuit operably connected to the infrared lights, wherein the control circuit is configured to receive input commands and selectively activate the plurality of infrared lights in order to heat liquid water within the reservoir.

* * * * *